US007059002B2

(12) United States Patent
Lee et al.

(10) Patent No.: US 7,059,002 B2
(45) Date of Patent: Jun. 13, 2006

(54) DEHYDRATION CONTROL METHOD OF DRUM WASHING MACHINE

(75) Inventors: Tae-Hee Lee, Seoul (KR); Kyung-Chul Woo, Seoul (KR); Soo-Young Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 528 days.

(21) Appl. No.: 10/330,122

(22) Filed: Dec. 30, 2002

(65) Prior Publication Data

US 2003/0213070 A1 Nov. 20, 2003

(30) Foreign Application Priority Data

May 17, 2002 (KR) ..... 10-2002-0027526

(51) Int. Cl.
*D06F 33/00* (2006.01)

(52) U.S. Cl. ..... 8/158

(58) Field of Classification Search ..... 8/158–159
See application file for complete search history.

(56) References Cited

U.S. PATENT DOCUMENTS

| | | | | |
|---|---|---|---|---|
| 4,513,464 | A | 4/1985 | Rettich et al. | |
| 5,970,555 | A * | 10/1999 | Baek et al. | 8/159 |
| 6,029,299 | A * | 2/2000 | Baek et al. | 8/159 |
| 6,401,284 | B1 * | 6/2002 | Jeon et al. | 8/158 |
| 6,640,372 | B1 * | 11/2003 | Ciancimino et al. | 8/159 |
| 6,826,932 | B1 * | 12/2004 | Sonoda et al. | 68/12.06 |
| 2001/0054204 | A1 | 12/2001 | Ciancimino et al | |
| 2003/0213070 | A1 | 11/2003 | Lee et al. | |
| 2005/0076456 | A1 | 4/2005 | Lee et al. | |

FOREIGN PATENT DOCUMENTS

| | | |
|---|---|---|
| DE | 3342376 | 6/1984 |
| DE | 19738310 | 3/1999 |
| EP | 0750065 | 12/1996 |
| EP | 1 3 6 2 9 4 6 | 11/2003 |
| JP | 2001-276468 | 10/2001 |
| KR | 1999-017414 | 8/1999 |
| WO | 00/28128 | 5/2000 |

OTHER PUBLICATIONS

English language abstract of JP2001-276468.
English Language Abstract of KOREA 1999-017414.
English Language Abstract of DE 19738310.
English Language Abstract of DE 3342376.

* cited by examiner

*Primary Examiner*—Joseph L. Perrin
(74) *Attorney, Agent, or Firm*—Greenblum & Bernstein, P.L.C.

(57) ABSTRACT

A dehydration control method of a drum washing machine includes accelerating a drum to a first rotational speed when a uniforming process is finished, measuring first eccentricity when the rotational speed of the drum reaches the first rotational speed, comparing the measured first eccentricity with a preset first reference eccentricity, storing the measured first eccentricity when the measured first eccentricity is less than the preset first reference eccentricity, accelerating the rotational speed of the drum to a second rotational speed and measuring a second eccentricity when the rotational speed reaches the second rotational speed, comparing the measured second eccentricity with the stored first measured eccentricity, and performing a dehydrating process when the measured second eccentricity is less than the stored first measured eccentricity.

11 Claims, 6 Drawing Sheets

DEHYDRATION CONTROL METHOD OF DRUM WASHING MACHINE

BACKGROUND OF THE INVENTION

1. Field of the Invention

The present invention relates to a drum washing machine, and in particular to a dehydration control method of a drum washing machine which is capable of preventing vibration and noise due to excessive eccentricity and securing reliability of eccentricity sensing.

2. Description of the Prior Art

In general, a drum washing machine performs a dehydrating process through a uniforming process after a cleaning process is finished. Herein, the uniforming process is for uniforming the laundry tangled in the cleaning process, tangle of the laundry is loosened by separating the laundry from the internal wall of a drum by rotating the drum at a low speed. And, after the uniforming process is finished, in the dehydrating process, the drum is rotated at a high speed in the opposite direction of the uniforming process, and accordingly moisture contained in the laundry is removed.

Herein, when the drum is rotated at a high speed in the dehydrating process and the laundry is eccentrically placed in the drum, vibration and noise occur, various parts installed inside the washing machine may be damaged or dehydration performance may be lowered.

Therefore, the drum washing machine senses eccentricity of the laundry stored in the drum after the uniforming process and determines whether it proceeds the dehydrating process.

FIG. 1 is a flow chart illustrating a dehydration control method of a drum washing machine in accordance with the conventional art.

As depicted in FIG. 1, in the conventional dehydration control method of the drum washing machine, after the cleaning process is finished, the uniforming process for uniforming tangle of the laundry is performed as shown at step S1, when the uniforming process is finished, the drum is rotated in the opposite direction of the uniforming process up to a set speed as shown at step S2. And, when a rotational speed of the drum reaches the set speed, RPM variation of a driving motor rotating the drum is measured as shown at step S3.

Eccentricity of the laundry is measured on the basis of the RPM variation of the driving motor, the measured eccentricity is compared with a preset reference eccentricity, when the measured eccentricity is within the range of a permitted limit, the dehydrating process is performed, when the measured eccentricity exceeds the permitted limit, the uniforming process is re-performed as shown at steps S4 and S5.

As described above, when the measured eccentricity is greater than the reference eccentricity, the uniforming process is re-performed in order to lower the eccentricity of the laundry so as to be within the permitted limit.

However, in the conventional dehydration control method of the drum washing machine, because eccentricity of the laundry is judged by measuring RPM variation of the driving motor only in one case, a measuring result is not accurate. Particularly, because diagonal eccentricity can not be sensed accurately, reliability of an eccentricity measuring value is lowered.

Herein, the laundry may be arranged eccentrically in many ways, however, it can be largely divided into forward eccentricity and diagonal eccentricity. In more detail, as depicted in FIG. 2, in taking a side view of a drum 10, when the laundry is placed on only one of a first position 20 and a second position 30, it is called the forward eccentricity, when the laundry is placed on both the first and second positions 20, 30, it is called as the diagonal eccentricity.

When the diagonal eccentricity occurs, in taking a front view of the drum 10, it looks as if eccentricity does not occur, however, RPM variation is different from that of the forward eccentricity in proceeding of the dehydrating process.

FIG. 3 is a graph showing RPM variation in the forward eccentricity according to an acceleration time increase of the drum in accordance with the conventional art, and FIG. 4 is a graph showing RPM variation in the diagonal eccentricity according to an acceleration time increase of the drum in accordance with the conventional art.

As depicted in FIG. 3, in the forward eccentricity, when the drum is rotated at a low speed, namely, in the early dehydrating process, RPM variation is the greatest, and RPM variation is gradually lowered according to a rotational speed increase of the drum.

As described-above, in the forward eccentricity, because RPM variation is great in the early dehydrating process, it is possible to grasp eccentricity occurrence by measuring RPM variation at an early rotational speed (P) of the drum.

However, as depicted in FIG. 4, in the diagonal eccentricity, early RPM variation is small, then, RPM variation increases according to a gradual rotational speed increase of the drum. Because RPM variation is measured at one fixed rotational speed (P) in the early dehydrating process in the conventional art, it is impossible to detect eccentricity occurrence, and accordingly reliability of eccentricity sensing is lowered. In addition, because vibration and noise occur due to the eccentricity occurrence, internal parts of the washing machine may be damaged, and a dehydration performance of the washing machine may be lowered.

SUMMARY OF THE INVENTION

In order to solve the above-mentioned problem, it is an object of the present invention to provide a dehydration control method of a drum washing machine which is capable of improving reliability of eccentricity sensing, lowering noise and vibration occurred in a dehydrating process and improving a dehydration performance by sensing not only forward eccentricity but also diagonal eccentricity by performing eccentricity sensing at a low speed and a high speed.

In order to achieve the above-mentioned object, a dehydration control method of a drum washing machine in accordance with the present invention includes a first step for accelerating a drum to a first rotational speed when a uniforming process is finished; a second step for measuring first eccentricity when the rotational speed of the drum reaches the first rotational speed; a third step for comparing the measured first eccentricity with a preset first reference eccentricity; a fourth step for storing the measured first eccentricity when the measured first eccentricity is less than the preset first reference eccentricity in the third step; a fifth step for accelerating the rotational speed of the drum to a second rotational speed and measuring a second eccentricity when it reaches the second rotational speed; a sixth process for comparing the measured second eccentricity with the stored first eccentricity; and a seventh step for performing a dehydrating process when the measured second eccentricity is less than the stored first eccentricity.

The method further includes re-performing the uniforming process after stopping the rotation of the drum when the first eccentricity measured in the third step is greater than the preset reference eccentricity.

The sixth step includes the sub-steps of comparing the measured second eccentricity with a preset second reference eccentricity when the measured second eccentricity is greater than the stored first eccentricity; and performing the dehydrating process when the second eccentricity is less than the second reference eccentricity or re-performing the uniforming process after stopping the rotation of the drum when the second eccentricity is greater than the second reference eccentricity.

The sixth step further includes the sub-steps of comparing the measured second eccentricity with a preset second reference eccentricity when the measured second eccentricity is greater than the stored first eccentricity; and performing the dehydrating process when the second eccentricity is less than the second reference eccentricity.

The sixth step further includes the sub-step of re-performing the uniforming process after stopping the rotation of the drum when the second eccentricity is less than the second reference eccentricity.

Eccentricity is obtained by measuring RPM variation of the driving motor with a RPM sensing unit installed at the driving motor for driving the drum.

The uniforming process is performed within the range of 50~58 RPM.

The first rotational speed is within the range of 100~108 RPM.

The first rotational speed is maintained for about 7 seconds.

The second rotational speed is about 180 RPM.

The second rotational speed is maintained for about 7 seconds.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of the present invention will be described with reference to accompanying drawings.

Figure 1:
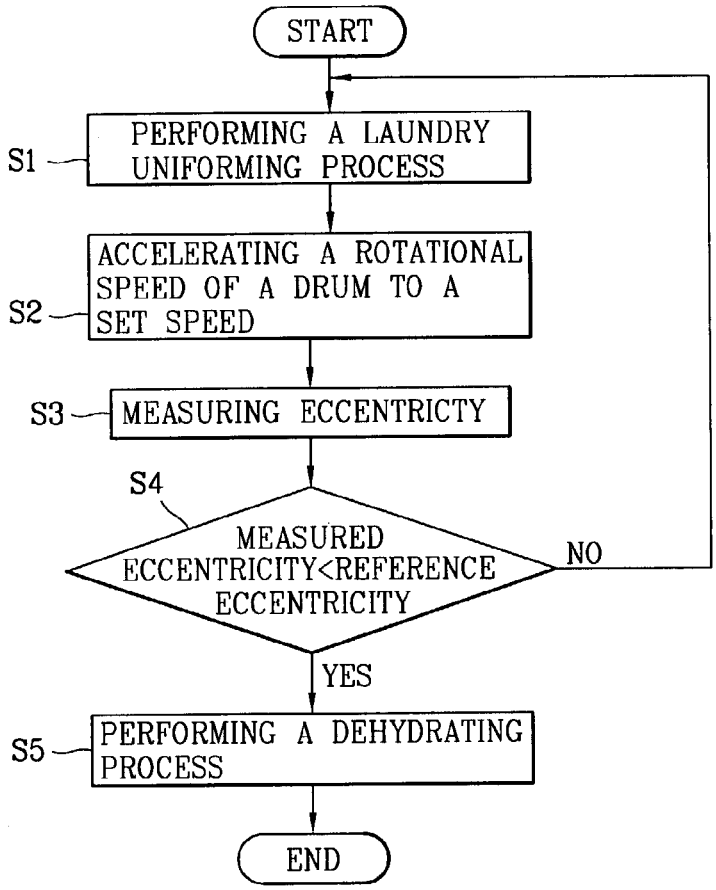
FIG. 1 BACKGROUND ART
FIG. 1 is a flow chart illustrating a dehydration control method of a drum washing machine in accordance with the conventional art.
Figure 2:
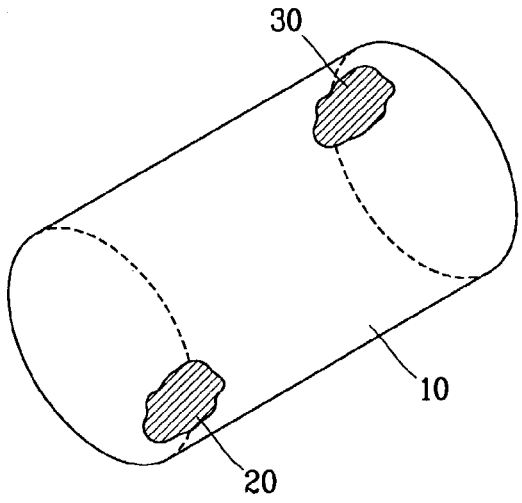
FIG. 2 BACKGROUND ART
FIG. 2 is a perspective view illustrating forward eccentricity and diagonal eccentricity occurred in a general drum washing machine.
Figure 3:
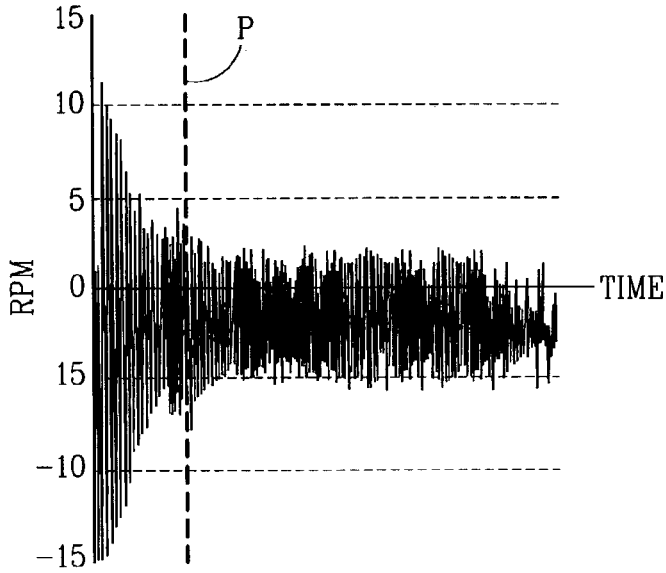
FIG. 3 BACKGROUND ART
FIG. 3 is a graph showing RPM variation in forward eccentricity according to a time increase in a dehydrating-process in accordance with the conventional art.
Figure 4:
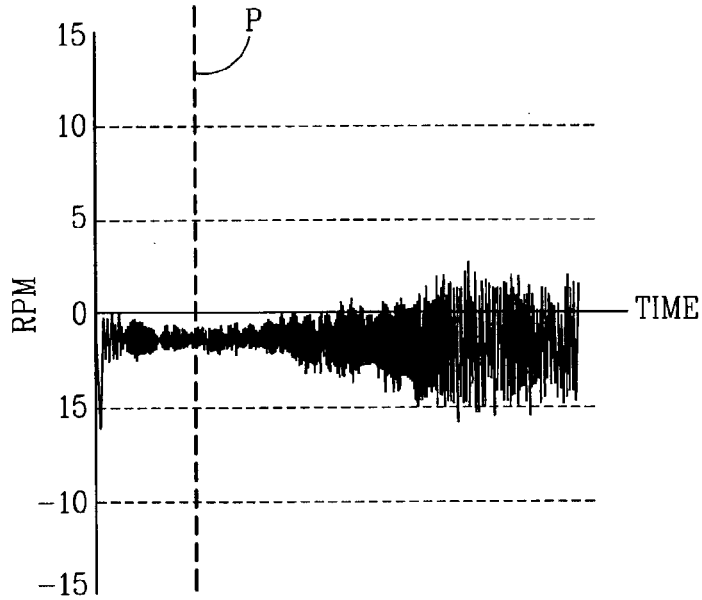
FIG. 4 BACKGROUND ART
FIG. 4 is a graph showing RPM variation in diagonal eccentricity according to a time increase in a dehydrating-process in accordance with the conventional art.
Figure 5:
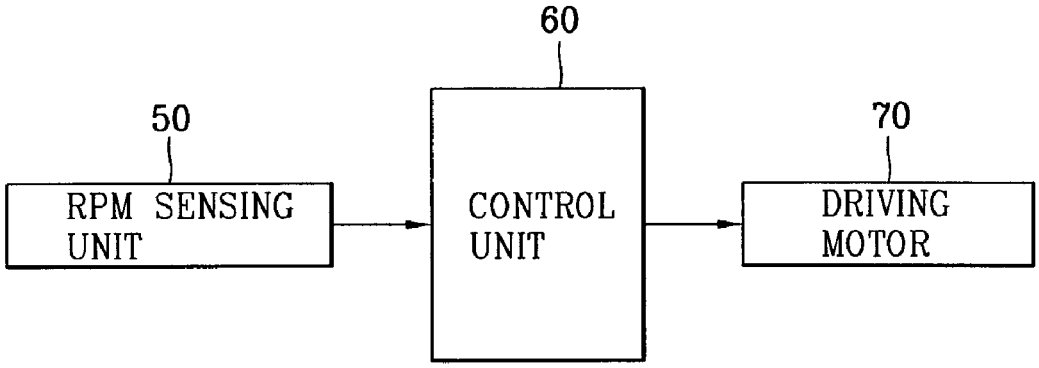
FIG. 5 is a block diagram illustrating a dehydration control apparatus of a drum washing machine in accordance with the present invention.
Figure 6:
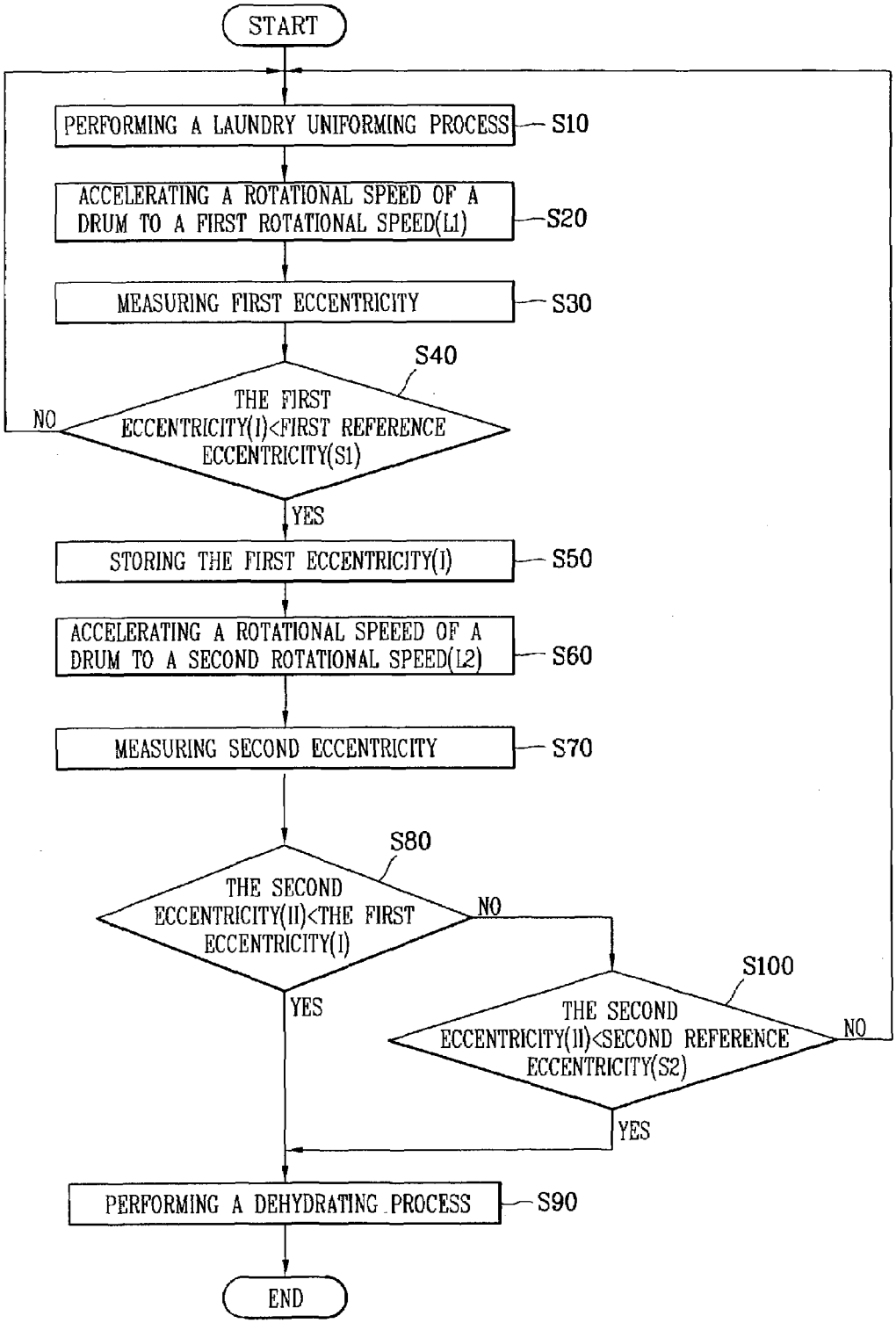
FIG. 6 is a flow chart illustrating a dehydration control method of a drum washing machine in accordance with the present invention.
Figure 7:
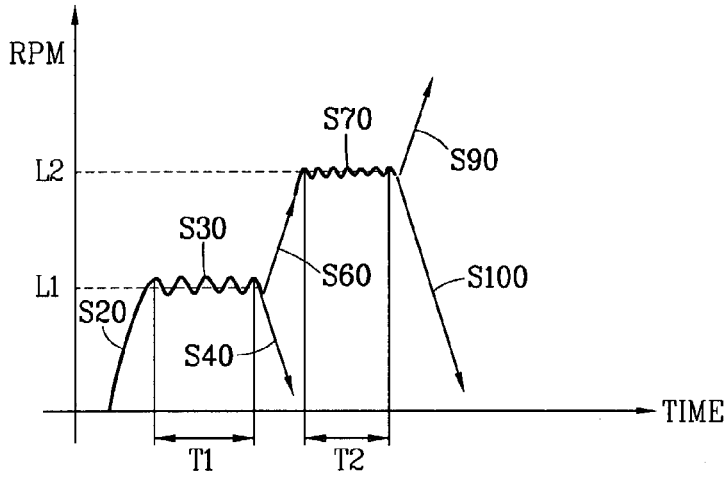
FIG. 7 is a graph showing an eccentricity measuring process in a dehydratingprocess in accordance with the present invention.

FIG. 5 is a block diagram illustrating a dehydration control apparatus of a drum washing machine in accordance with the present invention, FIG. 6 is a flow chart illustrating a dehydration control method of a drum washing machine in accordance with the present invention, and FIG. 7 is a graph showing an eccentricity measuring process in a dehydrating process in accordance with the present invention.

The dehydration control apparatus includes a RPM sensing unit 50 installed at a driving motor driving the drum and measuring RPM of the driving motor; a control unit 60 for judging eccentricity occurrence according to a signal applied from the RPM sensing unit 50; and a driving motor 70 for adjusting a rotational speed of the drum according to the signal applied from the control unit 60.

Next, a dehydrating process of the drum washing machine will be described in detail with reference to accompanying FIG. 6 and FIG. 7.

First, after the cleaning process of the drum washing machine is finished, a uniforming process for uniforming tangle of the laundry is performed as shown at step S10. Herein, in the uniforming process, it is preferable to maintain RPM of the driving motor 70 for driving the drum within the range of 50~58 RPM.

When the uniforming process is finished, a rotational speed of the drum is accelerated and is maintained as a first rotational speed (L1) as shown at step S20. In more detail, by accelerating the rotational speed of the drum and rotating the drum in the opposite direction of the uniforming process, the first rotational speed (L1) of the driving motor 70 is maintained as about 100~108 RPM. Herein, a maintaining time (T1) of the first rotational speed (L1) of the driving motor 70 is about 7 seconds.

When the drum maintains the first rotational speed (L1) in rotation, first RPM variation of the driving motor 70 is measured as shown at step S30. First eccentricity (I) of the laundry is grasped according to the measured first RPM variation, and the measured first eccentricity (I) is compared with preset first reference eccentricity (S1) as shown at step S40.

In more detail, when the first RPM variation is applied from the RPM sensing unit 50 to the control unit 60, the control unit 60 grasps the measured first eccentricity (I) of the laundry on the basis of the first RPM variation and compares the measured first eccentricity (I) with the first reference eccentricity (S1).

In the judging result, when the measured first eccentricity (I) exceeds a permitted limit, the rotation of the drum is stopped, and the uniforming process is re-performed. And, in the judging result, when the measured first eccentricity (I) is within the permitted limit, the measured first eccentricity (I) is stored as shown at step S50.

After storing the measured first eccentricity (I), the drum is accelerated to a second rotational speed (L2) and is rotated at that speed for a certain time as shown at step S60. In more detail, by accelerating the drum rotating at the first rotational speed (L1) more, the driving motor maintains about 180 RPM in the rotation at the second rotational speed (L2). Herein, it is preferable for a maintenance time of the second rotational speed to be about 7 seconds.

In that process, when the drum maintains the second rotational speed (L2) in the rotation, a second eccentricity (II) is measured and is compared with the stored first eccentricity (I) as shown at steps S70 and S80. In more detail, by measuring the second RPM variation at the second rotational speed of the motor with the RPM sensing unit 50 installed at the side of the driving motor and transmitting it to the control unit 60, the control unit 60 grasps the second measured eccentricity (II) on the basis of the second RPM variation and compares the second measured eccentricity (II) with the stored measured first eccentricity (I).

when it is judged the second measured eccentricity (II) is less than the stored measured first eccentricity (I), the second measured eccentricity (II) is within the permitted limit, and accordingly the dehydrating process is performed as shown at step S90.

And, when it is judged the second measured eccentricity (II) is greater than the stored measured first eccentricity (I), the second measured eccentricity (II) is compared with a preset second reference eccentricity (S2) as shown at step S100.

When it is judged the second measured eccentricity (II) is greater than the preset second reference eccentricity (S2), it is judged the eccentricity of the laundry exceeds the permitted limit, and accordingly the uniforming process is re-performed. And, when it is judged the second measured eccentricity (II) is less than the preset second reference eccentricity (S2), the dehydrating process is performed by rotating the driving motor at a high speed.

Advantages of the control method of the drum washing machine in accordance with the present invention will be described.

Figure 8:
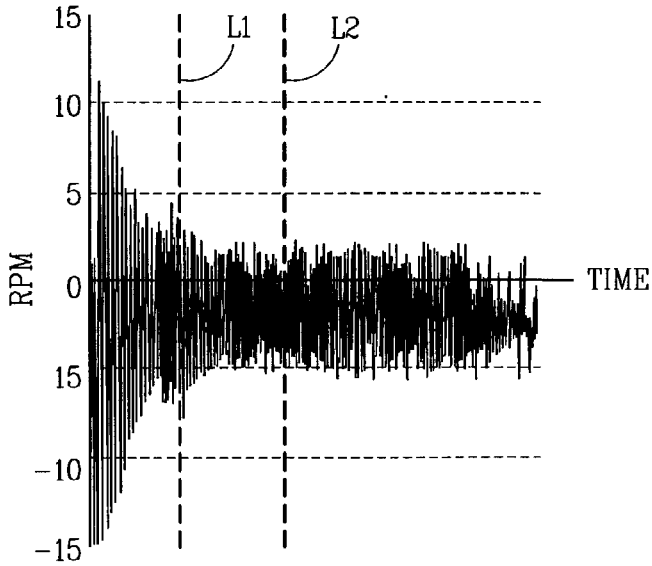
FIG. 8 is a graph showing RPM variation in forward eccentricity according to an acceleration time increase of a drum in accordance with the present invention.

As depicted in FIG. 8, in the forward eccentricity, because RPM variation is great in the early dehydration process, eccentricity occurrence can be grasped sufficiently by measuring RPM variation at the first rotational speed (L1) of the driving motor 70.

Figure 9:
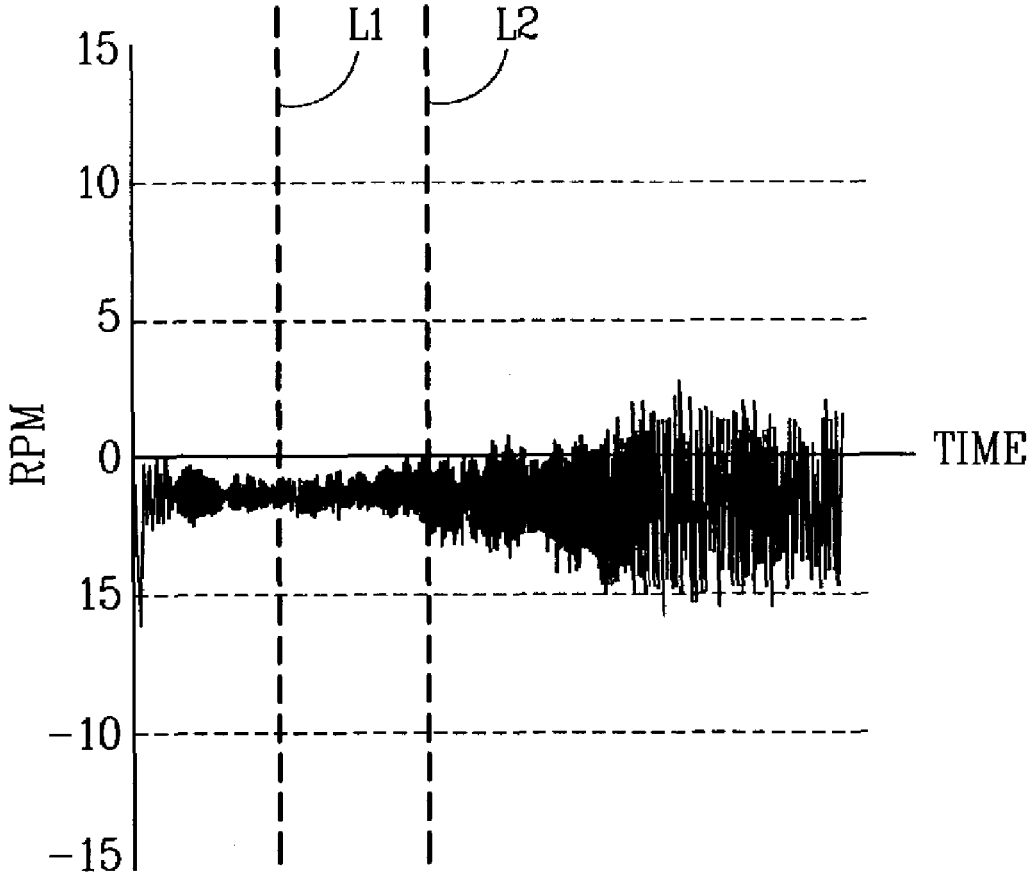
FIG. 9 is a graph showing RPM variation in diagonal eccentricity according to an acceleration time increase of the drum in accordance with the present invention.

And, in the diagonal eccentricity, as depicted in FIG. 9, early RPM variation is small, then, RPM variation increases according to a gradual increase rotational speed of the drum, eccentricity occurrence can be grasped sufficiently by measuring RPM variation at the second rotational speed (L2) of the driving motor 70.

As described above, in the dehydration control method of the drum washing machine in accordance with the present invention, by measuring RPM variation at a low rotational speed and a high rotational speed of the drum respectively, not only forward eccentricity but also diagonal eccentricity occurrence can be sufficiently grasped, and accordingly it is possible to improve reliability of eccentricity measuring, lower noise and vibration occurred in a cleaning process of the drum washing machine and improve a dehydration performance.

What is claimed is:

1. A dehydration control method of a drum washing machine, comprising:

accelerating a drum to a first rotational speed when a uniforming process is finished;

measuring first eccentricity when the rotational speed of the drum reaches the first rotational speed;

comparing the measured first eccentricity with a preset first reference eccentricity;

storing the measured first eccentricity when the measured first eccentricity is less than the preset first reference eccentricity;

accelerating the first rotational speed of the drum to a second rotational speed and measuring a second eccentricity when the rotational speed reaches the second rotational speed;

comparing the measured second eccentricity with the stored first measured eccentricity; and performing a dehydrating process when the measured second eccentricity is less than the stored first measured eccentricity.

2. The method of claim 1, further comprising: re-performing the uniforming process after stopping the rotation of the drum when the first eccentricity measured in the measuring is greater than the preset reference eccentricity.

3. The method of claim 2, wherein the comparing comprises:

comparing the measured second eccentricity with a preset second reference eccentricity when the measured second eccentricity is greater than the stored first eccentricity; and performing the dehydrating process when the second eccentricity is less than the second reference eccentricity or re-performing the uniforming process after stopping the rotation of the drum when the second eccentricity is greater than the second reference eccentricity.

4. The method of claim 1, wherein the comparing further comprises:

comparing the measured second eccentricity with a preset second reference eccentricity when the measured second eccentricity is greater than the stored first eccentricity; and performing the dehydrating process when the second eccentricity is less than the second reference eccentricity.

5. The method of claim 4, wherein the comparing further comprises re-performing the uniforming process after stopping the rotation of the drum when the second eccentricity is less than the second reference eccentricity.

6. The method of claim 1, wherein eccentricity is obtained by measuring RPM variation of the driving motor with a RPM sensing unit installed at the driving motor that drives the drum.

7. The method of claim 1, wherein the uniforming process is performed within the range of 50.about.58 RPM.

8. The method of claim 1, wherein the first rotational speed is within the range of 100.about.108 RPM.

9. The method of claim 1, wherein the first rotational speed is maintained for about 7 seconds.

10. The method of claim 1, wherein the second rotational speed is about 180 RPM.

11. The method of claim 1, wherein the second rotational speed is maintained for about 7 seconds.

* * * * *